US007516797B2

(12) United States Patent
Khomynets

(10) Patent No.: US 7,516,797 B2
(45) Date of Patent: Apr. 14, 2009

(54) METHOD FOR OPERATING A WELL JET DEVICE IN THE CONDITIONS OF A FORMATION HYDRAULIC FRACTURING

(76) Inventor: Zinoviy Dmitrievich Khomynets, kv.4, d.46, Zeleny pr-t, Moscow (RU) 111396

( * ) Notice: Subject to any disclaimer, the term of this patent is extended or adjusted under 35 U.S.C. 154(b) by 68 days.

(21) Appl. No.: 11/720,259

(22) PCT Filed: Nov. 21, 2005

(86) PCT No.: PCT/RU2005/000586

§ 371 (c)(1),
(2), (4) Date: May 25, 2007

(87) PCT Pub. No.: WO2006/068535

PCT Pub. Date: Jun. 29, 2006

(65) Prior Publication Data

US 2007/0256837 A1 Nov. 8, 2007

(30) Foreign Application Priority Data

Dec. 20, 2004 (RU) ..... 2004137140 U

(51) Int. Cl.
*E21B 43/00* (2006.01)
*E21B 43/26* (2006.01)

(52) U.S. Cl. ..... 166/370; 417/151

(58) Field of Classification Search ..... 166/308.1, 166/370, 242.5, 142, 105; 417/151
See application file for complete search history.

(56) References Cited

U.S. PATENT DOCUMENTS

| | | | | |
|---|---|---|---|---|
| 2,946,565 | A * | 7/1960 | Williams | 166/264 |
| 4,988,389 | A * | 1/1991 | Adamache et al. | 166/302 |
| 5,055,002 | A | 10/1991 | Roeder | |
| 6,899,188 | B2 * | 5/2005 | Hughes et al. | 175/57 |
| 2004/0188143 | A1 | 9/2004 | Hughes et al. | |

FOREIGN PATENT DOCUMENTS

| | | | |
|---|---|---|---|
| RU | 2121610 | C1 * | 11/1998 |
| RU | 2205993 | C1 * | 6/2003 |

* cited by examiner

*Primary Examiner*—Jennifer H Gay
*Assistant Examiner*—Daniel P Stephenson
(74) *Attorney, Agent, or Firm*—patenttm.us

(57) ABSTRACT

A well jet device operating method comprises running a jet pump into a well, releasing a packer above a productive formation, pumping hydraulic fracturing fluid though a blocking insert in the pump channel, extracting the blocking insert, running flexible pipe into the well through a sealing unit and arranging the lower end thereof at lower formation perforation interval level. The formation is drained, fluid for washing a bottomhole is supplied by the flexible pipe, maintaining the ratio between pipe pressure value and a casing annulus working medium pressure within a range greater than or equal to 0.98. When at least two volumes of hydraulic fracturing fluid is extracted, the pipe fluid supply is stopped. At least 5 minutes after, off the working medium supply to the pump nozzle is shut off, in examining the formation for evaluating the productivity thereof and in bringing the well into operation.

1 Claim, 2 Drawing Sheets

METHOD FOR OPERATING A WELL JET DEVICE IN THE CONDITIONS OF A FORMATION HYDRAULIC FRACTURING

FIELD OF THE INVENTION

This invention relates to pump equipment, primarily to well jet devices for extracting oil from wells.

PRIOR ART

A method of operating a well jet device is known in the art, which comprises lowering into a borehole a flow string with a jet pump, a packer and a puncher, arranging the puncher against a productive formation and blasting the perforator with subsequent pumping of liquid working medium through the jet pump (SU 1146416 A1).

The known method of operating such devices enables to perforate a well and due to this intensify a well yield of various extracted media, e.g., oil.

However, this operating method does not enable to study near-well areas, which in a number of cases leads to a reduced efficiency of works on intensifying well operation due to lack of information on behavior of perforated formations. Thus, work efficiency of draining a well does not give expected results.

The closest to this invention as to technical essence and achieved result is a method for operating a well jet device, which comprises installing on a flow string a jet pump with a through passage and a packer, lowering this assembly to a borehole, releasing the packer and creating a required differential pressure drawdown in the under-packer area by pumping a liquid medium out of the under-packer area with a jet pump (RU 2121610 C1).

The known method of operating a well jet device enables conducting various process operations in a well below the level at which a jet pump is installed, including carrying out operations by reducing differential pressures above and below a sealing unit.

However, this operating method does not enable using its capabilities in full, since it does not enable conducting both treatment of a productive formation and washing of the well bottom, which narrows the field of application of that method of operating a well jet unit. Moreover, its operation parameters and operation sequence are not optimized for carrying out works on hydraulic fracturing of a productive formation and washing of the well bottom during one study cycle in a well.

SUMMARY OF THE INVENTION

The objective of this invention is to increase intensification of works on studying, testing and conditioning wells as well as to improve reliability of obtained data on preparedness of a well for operation in the working mode.

The stated objective is achieved due to the fact that the inventive method for operating a well jet device comprises: lowering on a flow string a jet pump with a stepped through passage made in the body thereof and a packer with a through passage and a stem with an inlet funnel; releasing the packer thereafter, wherein the packer being arranged above a productive formation; arranging a blocking insert with a central through passage into the said stepped through passage; and pumping a hydraulic fracturing fluid or a mixture of a hydraulic fracturing fluid with chemical agents into the said productive formation; further extracting the said blocking insert to the surface and lowering a flexible tube, being passed through a sealing unit with the possibility of being moved relative to the latter, into the well through the flow string, and installing the lower end of the flexible tube below or at the same level with the lower perforation interval of the productive formation, during the process of lowering the said sealing unit being arranged in the said through passage of the jet pump; delivering a liquid working medium to the jet pump nozzle over the well annulus; and draining the productive formation by creating differential pressure drawdown in the under-packer area of the well; a fluid for washing the well bottom being delivered to the well by the flexible tube at the same time with or after creating stable differential pressure drawdown on the productive formation, the relation between a pressure $P_f$ in the flexible tube and a pressure $P_w$ of the said liquid working medium being maintained within the range $(P_f:P_w)\leqq 0.98$; stopping supplying the fluid for washing the well bottom after pumping out fluid of the productive formation in a quantity equal to at least twice the quantity of the hydraulic fracturing fluid, or a mixture of a hydraulic fracturing fluid and chemical agents, pumped into the productive formation; and thereafter, but not earlier than in 5 minutes, stopping supplying the liquid working medium into the jet pump nozzle; and thereafter extracting the flexible tube together with the sealing unit from the well and conducting hydrodynamic and geophysical studies of the productive formation with the use of a jet pump in order to evaluate its productivity; finally carrying out works on putting the well into operation.

An analysis of the well jet device operation has shown that the operational reliability may be increased both by optimizing the operation sequence during testing and developing wells and by making the operation sequence in the well more optimized.

It has been established that the above sequence of operations enables to most effectively use the equipment arranged on the flow string when carrying out works on studying and testing productive formations in rocks, creating conditions for obtaining most complete and reliable data on the status of productive formations. The installed flexible tube passed through the sealing unit with the possibility of being moved axially enables carry out high-quality works on conditioning a well for operating in the working mode. A well may be treated and prepared for operation without repeated installation of the well jet device, which also enables to accelerate and simplify the procedures of testing and conditioning a well for operation. By creating a differential pressure drawdown the jet pump creates a preset differential pressure in a well, and a fluid for washing the well bottom is delivered into the well by the flexible tube, which enables to remove both any propant that is not fixed in cracks and the fluid used for hydraulic fracturing together with chemical agents and products of their reactions with minerals contained in the productive formation. At this point, in order to wash the well efficiently it is important to observe the optimal relation between pressure values in the flexible tube ($P_f$) and pressures ($P_w$) of the liquid working medium in the well annulus, which must be maintained within the range $(P_f:P_w)\leqq 0.98$. At the same the possibility of monitoring a differential pressure drawdown value and the above-mentioned required pressure relation by controlling the pumping speed of the liquid working medium. Further, it is important to determine not only an optimal sequence of operation in the well, but also their duration. It has been established that after treatment of a productive formation it is sufficient to pump out fluid in a quantity equal to or less than twice the quantity of a hydraulic fracturing fluid or a mixture of a hydraulic fracturing fluid with chemical agents that has been pumped into the productive formation, and then the supply of a fluid for washing the well bottom may be stopped, and after it, but not earlier than in 5 minutes the supply of a liquid working fluid to the jet pump nozzle may be stopped as well.

Thus, the above-stated totality of interdependent parameters and the stated sequence of operations will ensure achievement of the invention objective—to increase intensification of works on studying, testing and conditioning a well, and increase reliability of data obtained on preparedness of a well for operation in the working mode.

DESCRIPTION OF PREFERRED EMBODIMENTS

Figure 1:
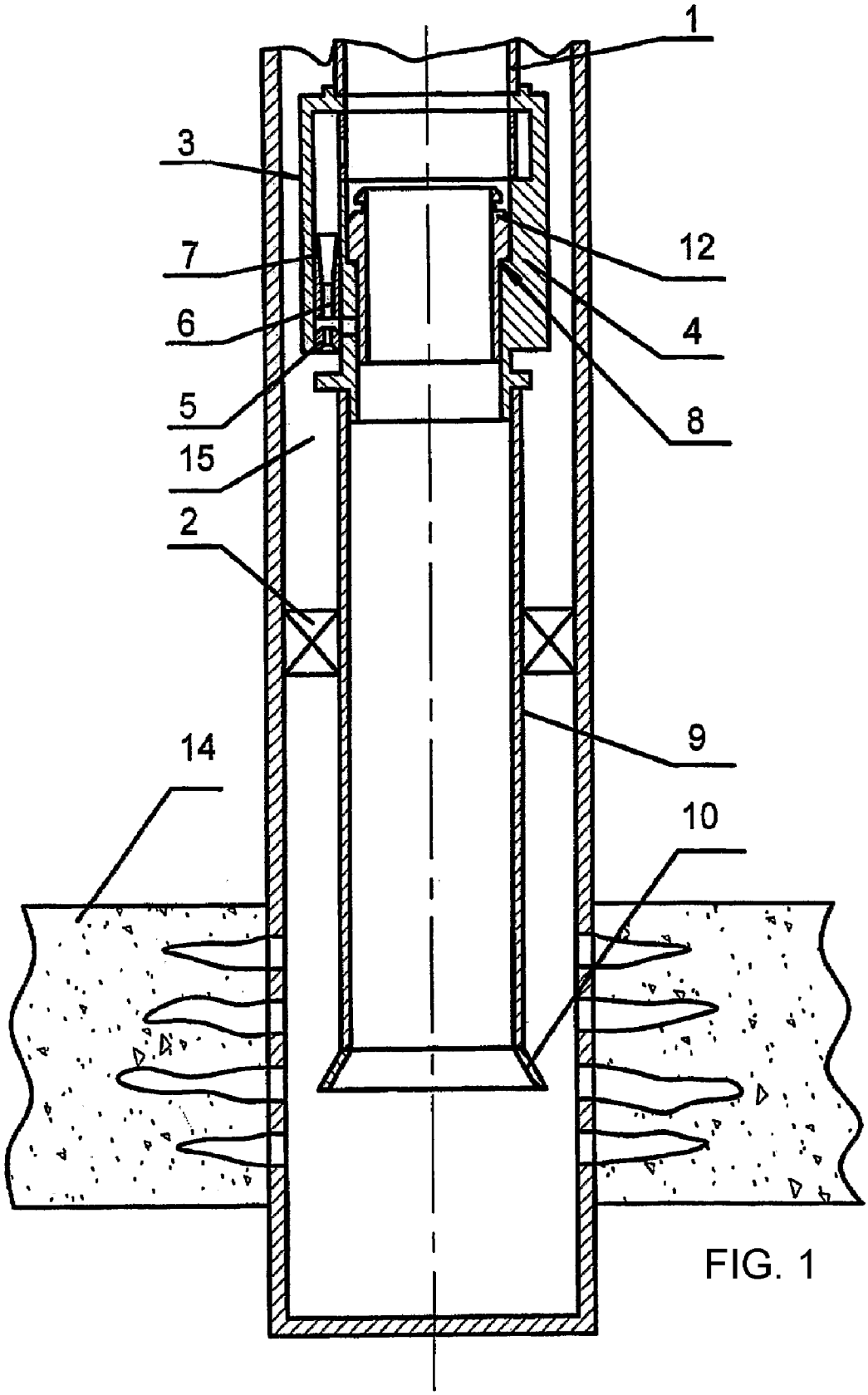
FIG. 1 shows a longitudinal section of the inventive device, wherein a blocking insert is arranged in the jet pump body.
Figure 2:
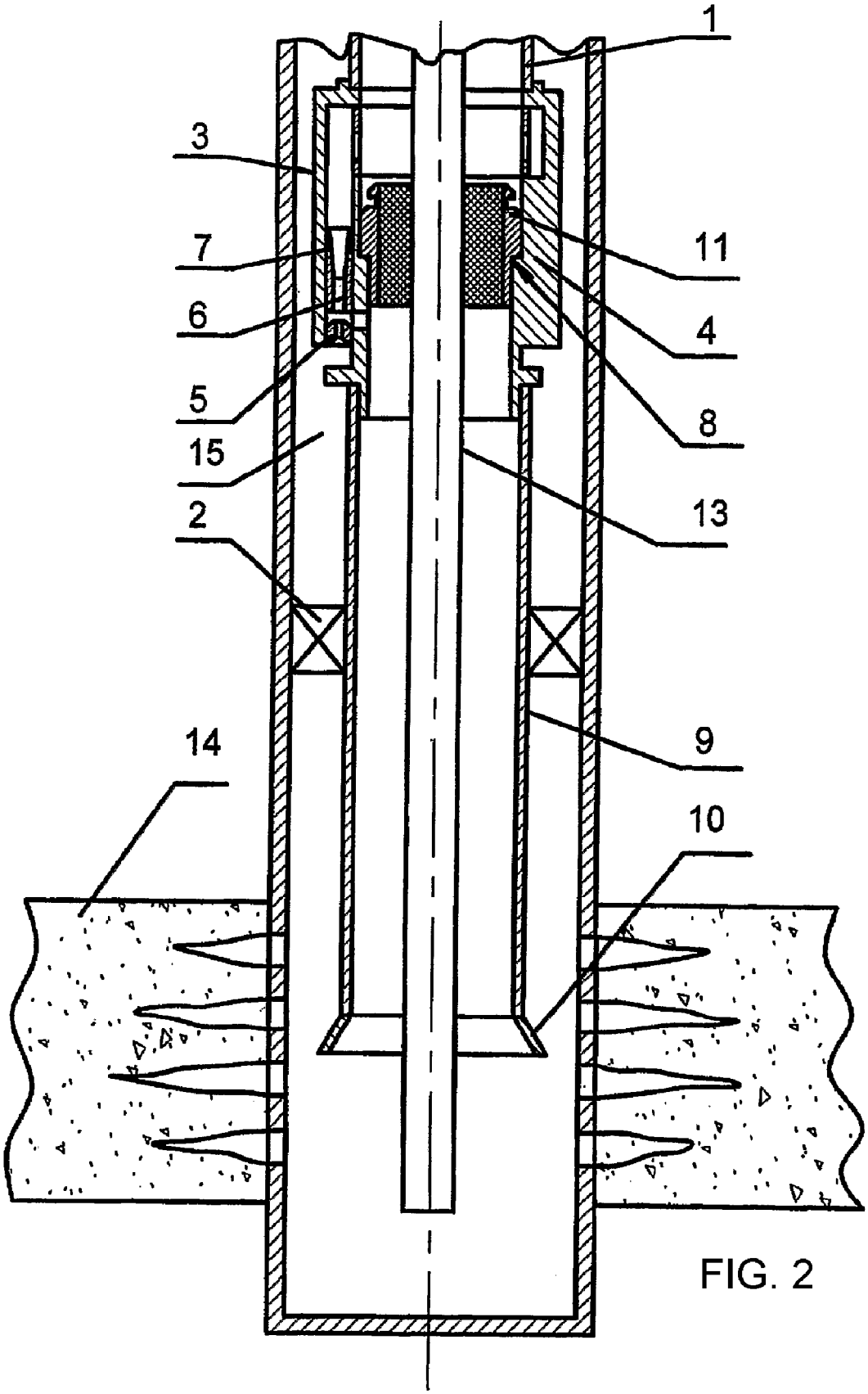
FIG. 2 shows a longitudinal section of the inventive device, wherein a flexible tube is passed through the jet pump and the sealing unit.

A well jet device for implementing the inventive method comprises, all being installed on a flow string 1, a packer 2 with a through passage, a jet pump 3 in the body 4 of which a nozzle 5 and a mixing chamber 6 with a diffuser 7 are arranged as well as a stepped through passage 8 is made, and a stem 9 with an inlet funnel 10 arranged below the jet pump 3. A sealing unit 11 or a blocking insert 12 may be arranged in the stepped through passage 8. A flexible tube 13 is passed through the sealing unit 11, the lower end of the flexible tube 13 being arranged below or at the level of the lower perforation interval of a productive formation 14. The jet pump 3 and the packer 2 are arranged in the well above the productive formation 14.

The inventive method for operating a well jet device at hydraulic fracturing of a formation is carried out as follows.

The jet pump 3 with the stepped through passage 8 made in the body 4 of the said pump and the packer 2 with the through passage and the stem 9 with the inlet funnel 10, which are arranged below the jet pump 3, are lowered into a well on a flow string. Then the packer 2 is released, while being arranged above the studied productive formation 14. Then the blocking insert 12 with a central through passage is arranged in the stepped through passage 8, and a fluid for hydraulic fracturing or a mixture of a fluid for hydraulic fracturing and chemical agents is pumped into the productive formation 14. Afterwards the blocking insert 12 is extracted to the surface, and the flexible tube 13, which is passed through the sealing unit 11 with the possibility of moving relative to the latter, is lowered into the well through the flow string 1. The lower end of the flexible tube 13 should be arranged below or at the level of the lower perforation interval of the productive formation 14. During the lowering step the sealing unit 11 is arranged in the stepped through passage 8 made in the jet pump 3. A liquid working medium is delivered over the well annulus 15 to the nozzle 5 of the jet pump 3, and the productive formation 14 is drained by creating in the under-packer area of the well a differential pressure drawdown on the productive formation 14. A fluid for washing the well bottom is delivered into the well by the flexible tube 13 simultaneously with or after creation of a stable differential pressure drawdown on the productive formation 14. The relation between pressure values in the flexible tube 13 ($P_f$) and a liquid working medium pressure ($P_w$) is maintained at $(P_f:P_w)\leqq 0.98$. After a fluid is pumped out of the productive formation 14 in a quantity equal to at least twice the quantity of a fluid for hydraulic fracturing or a mixture of a fluid for hydraulic fracturing and chemical agents the supply of a fluid for washing the well bottom by the flexible tube is stopped. And then, not earlier than in 5 minutes, the supply of the liquid working medium to the nozzle 5 of the jet pump 3 is also stopped. Afterwards, the flexible tube 13 together with the sealing unit 11 is extracted from the well, and hydrodynamic and geophysical studies of the productive formation 14 are carried out with the use of the jet pump 3 for the purpose of evaluating the productivity of the formation 14. Then works on putting the well into operation are carried out.

INDUSTRIAL APPLICABILITY

This invention may be advantageously used in the oil industry for testing, developing wells and carrying out well-workover, as well as in other industries engaged in extraction of various media from wells.

What is claimed is:

1. A method for operating a well jet device comprising:

lowering a jet pump on a flow string into a well, wherein the jet pump has a stepped through passage in the body thereof and a packer with a through passage and a stem with an inlet funnel, are arranged below the jet pump;

releasing the packer after arranging it above a productive formation;

arranging a blocking insert with a central through passage into the stepped through passage, and pumping a hydraulic fracturing fluid or a mixture of a hydraulic fracturing fluid with chemical agents into the productive formation;

extracting the blocking insert to the surface, and lowering a flexible tube passed through a sealing unit into the well through the flow string, said flexible tube adapted to being moved relative to the sealing unit;

arranging a lower end of the flexible tube below or at the same level with a lower perforation interval of the productive formation, arranging said sealing unit in the through passage of the jet pump during the process of lowering the sealing unit;

delivering a liquid working medium to the jet pump nozzle over the well annulus; and draining the productive formation by creating differential pressure drawdown in the under-packer area of the well, delivering a fluid for washing the well bottom to the well by the flexible tube at the same time with or after creating stable differential pressure drawdown on the productive formation, maintaining the relation between a pressure $P_f$ in the flexible tube and a pressure $P_w$ of the said liquid working medium being maintained within the range $(P_f:P_w)\leqq 0.98$;

stopping the supply of the fluid for washing the well bottom after pumping out a fluid of the productive formation or a mixture of the hydraulic fracturing fluid and chemical agents in a quantity equal to at least twice the quantity of the hydraulic fracturing fluid pumped into the productive formation, and thereafter, but not earlier than in 5 minutes, stopping the supply of the liquid working medium into the jet pump nozzle; afterwards, extracting the flexible tube together with the sealing unit from the well, and carrying out hydrodynamic and geophysical studies of the productive formation with the use of a jet pump in order to evaluate the productivity of the formation; and then carrying out works on putting the well into operation.

* * * * *